US007339482B2

(12) United States Patent
Jaeger et al.

(10) Patent No.: US 7,339,482 B2
(45) Date of Patent: Mar. 4, 2008

(54) SHIPPING CONTAINER AIR-VENT COVER ANTENNA HOUSING

(75) Inventors: Randy L. Jaeger, Orlando, FL (US); Richard T. Riley, Costa Mesa, CA (US); Peter S. Lauenstein, Seal Beach, CA (US)

(73) Assignee: The Boeing Company, Chicago, IL (US)

( * ) Notice: Subject to any disclaimer, the term of this patent is extended or adjusted under 35 U.S.C. 154(b) by 133 days.

(21) Appl. No.: 11/241,346

(22) Filed: Sep. 30, 2005

(65) Prior Publication Data

US 2007/0075075 A1 Apr. 5, 2007

(51) Int. Cl.
*G08B 13/14* (2006.01)

(52) U.S. Cl. ..... 340/572.7; 312/7.1; 343/872

(58) Field of Classification Search ..... 340/572.7
See application file for complete search history.

(56) References Cited

U.S. PATENT DOCUMENTS 6,339,397 B1 1/2002 Baker
6,753,775 B2 * 6/2004 Auerbach et al. ..... 340/539.22
2004/0041705 A1 * 3/2004 Auerbach et al. ..... 340/539.22
2005/0212671 A1 * 9/2005 Auerbach et al. ..... 340/539.1

FOREIGN PATENT DOCUMENTS

EP 0098725 A1 1/1984
GB 2107443 A 4/1983
GB 2359208 A 8/2001

OTHER PUBLICATIONS

European Search Report.

* cited by examiner

*Primary Examiner*—George Bugg
(74) *Attorney, Agent, or Firm*—Gates & Cooper LLP

(57) ABSTRACT

Apparatuses for mounting an antenna on a cargo container. An embodiment in accordance with the present invention comprises an antenna cover, disposed for mounting within a void of a corrugated wall of the cargo container, the antenna cover mounting over at least one opening in the corrugated wall of the cargo container, wherein the antenna is disposed through the at least one opening and mounted inside of the antenna cover, such that the antenna the antenna is disposed to perform a function selected from a group comprising transmitting radio frequency (RF) radiation from outside the cargo container and receiving RF radiation from outside the cargo container.

17 Claims, 5 Drawing Sheets

SHIPPING CONTAINER AIR-VENT COVER ANTENNA HOUSING

CROSS-REFERENCE TO RELATED APPLICATIONS

This application is related to U.S. patent application Ser. No. 11,240,994, entitled "SHIPPING CONTAINER SECURITY UNIT QUICK MOUNT DEVICE," by Randy L. Jaeger et al. and filed same date herewith, the contents of which are incorporated by reference herein.

BACKGROUND OF THE INVENTION

1. Field of the Invention

The present invention relates generally to shipping containers, and in particular, to a shipping container air-vent cover antenna housing.

2. Description of the Related Art

Shipping containers are used to transport goods all over the world. Many shipping containers are monitored to maintain a log of their whereabouts, as well as to monitor their estimated time of delivery to a given port or destination. There are over five million shipping containers in use today, and they typically transport over 500 billion dollars worth of goods into the United States on an annual basis.

In recent years, monitoring the flow of goods in these shipping containers has become more important. Since many goods are of higher value, the goods are under a larger threat of pilferage. Further, shipping containers could easily be tampered with to contain high explosives, or be used as a terrorist entry point into harbors and/or ports in the United States. The use of shipping containers for such purposes has been studied extensively by the Department of Homeland Security.

The current method of attaching tracking and/or monitoring devices is through the use of tape or other adhesives. The tape or adhesive material is used to affix the electronics boxes to the walls or ceiling of the container. The current method is very time consuming. Further, since this is typically done before the container is loaded and removed after the container is unloaded, additional loading time and unloading time is required for each container. Currently, using the tape and adhesive method, this attachment process for the electronic devices takes over an hour per container, to ensure that the electronics and associated wires that attach to an externally mounted antenna are not compromised by the container or the cargo within the shipping container.

The current method must also take into account that the cargo to be shipped in a given shipping container must not interfere with, damage, or otherwise contact the electronic devices. As such, the electronics devices and associated wires must be adhered to the container with excess tape and/or adhesive to ensure that any slight jarring of the container or of the electronic devices does not remove the electronic devices from their adhered positions.

Further, the electronics devices typically have antennas for transmission and reception of Radio Frequency (RF) signals, which can include Global Positioning System (GPS) signals, as well as cellular and other telecommunications signals. As such, some sort of antenna mount must be placed on the outside of the container. Since the cargo containers can be stacked on top of one another, the antenna must be mounted on the side of the cargo container to allow for transmission and reception of the RF signals. However, the antennas must be protected from damage, as well as protected from vandalism or tampering.

FIG. 1 illustrates a typical container. Container 100 is shown, with rail 102 running along the top and rail 104 running along the bottom. Typically, containers 100 that have vents contain vent ducts along the side panels at top rail 102 and bottom rail 104 to achieve a convection effect. Warm moist air is expelled via the upper ducts 106, where ducts 106 are typically holes drilled in wall 108, such that the warm moist air is replaced with colder ambient air via lower ducts (not shown).

The ducts 106 are currently used for air passage into and out of container 100. However, it can be seen that there is a need in the art for a device that makes it possible to mount an antenna on a cargo container where electronics are mounted inside of the container. It can also be seen that there is a need in the art for a device that makes installation of electronic devices on shipping containers easier and more efficient, and prevents damage or tampering with the antenna.

SUMMARY OF THE INVENTION

To minimize the limitations in the prior art, and to minimize other limitations that will become apparent upon reading and understanding the present specification, the present invention discloses apparatuses for mounting an antenna on a cargo container. An embodiment of the present invention comprises an antenna cover, disposed for mounting within a void of a corrugated wall of the cargo container, the antenna cover mounting over at least one opening in the corrugated wall of the cargo container, wherein the antenna is disposed through the at least one opening and mounted inside of the antenna cover, such that the antenna is disposed to perform a function selected from a group comprising transmitting radio frequency (RF) radiation from outside the cargo container and receiving RF radiation from outside the cargo container.

Such an embodiment optionally further includes a dimension of the antenna cover not extending beyond a depth of the void of the corrugated wall of the cargo container, the antenna transmitting RF radiation to report information related to the cargo container, the information comprising location of the cargo container or an entry log of the cargo container, the antenna cover further comprising an RF transmissive material or being electrically coupled to the antenna such that the antenna cover is used as the antenna.

Another embodiment of the present invention comprises a protective cover mounted on the cargo container, the protective cover having at least one opening which is disposed to allow air to flow between an inside of the cargo container and an outside of the cargo container, and an attachment mechanism to attach the antenna to the protective cover, wherein the antenna is disposed to receive radio frequency (RF) radiation.

Such an embodiment optionally includes the antenna being mounted underneath the protective cover the protective cover being electrically coupled to the antenna such that the protective cover is used as the antenna, the antenna being interwoven with the protective cover, the antenna transmitting RF radiation to report information related to the cargo container, the information comprising location of the cargo container or an entry log of the cargo container, and an RF transmissive material coupled to the antenna.

BRIEF DESCRIPTION OF THE DRAWINGS

Referring now to the drawings in which like reference numbers represent corresponding parts throughout.

DETAILED DESCRIPTION OF THE PREFERRED EMBODIMENTS

In the following description, reference is made to the accompanying drawings which form a part hereof, and which is shown, by way of illustration, several embodiments of the present invention. It is understood that other embodiments may be utilized and structural changes may be made without departing from the scope of the present invention.

Ventilation Schema

Figure 1:
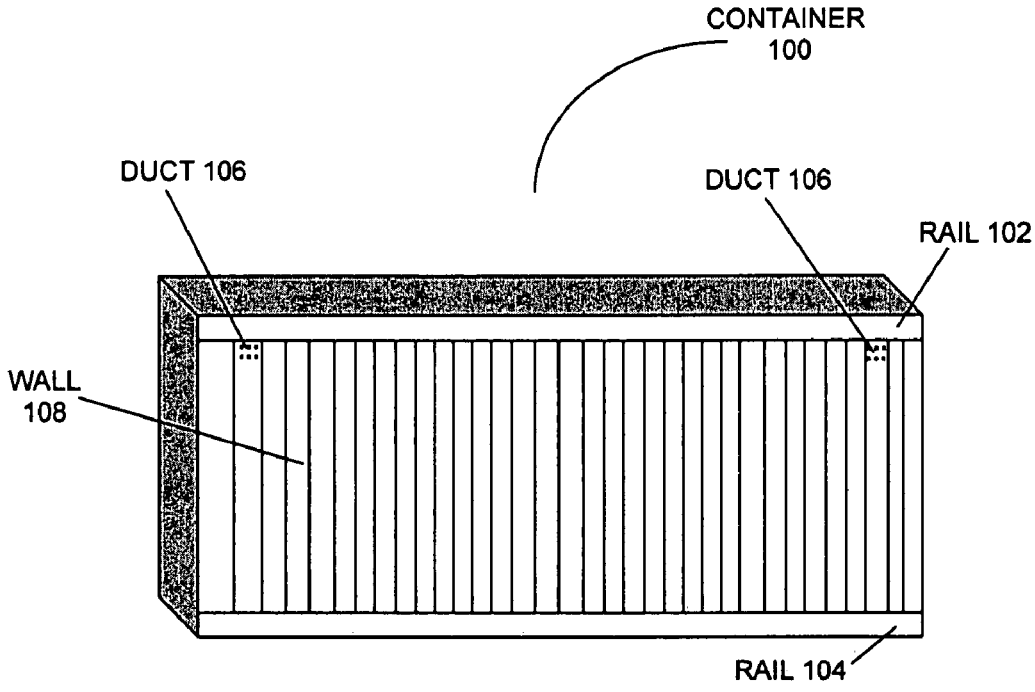
FIG. 1 illustrates a container of the related art.
Figure 2A:
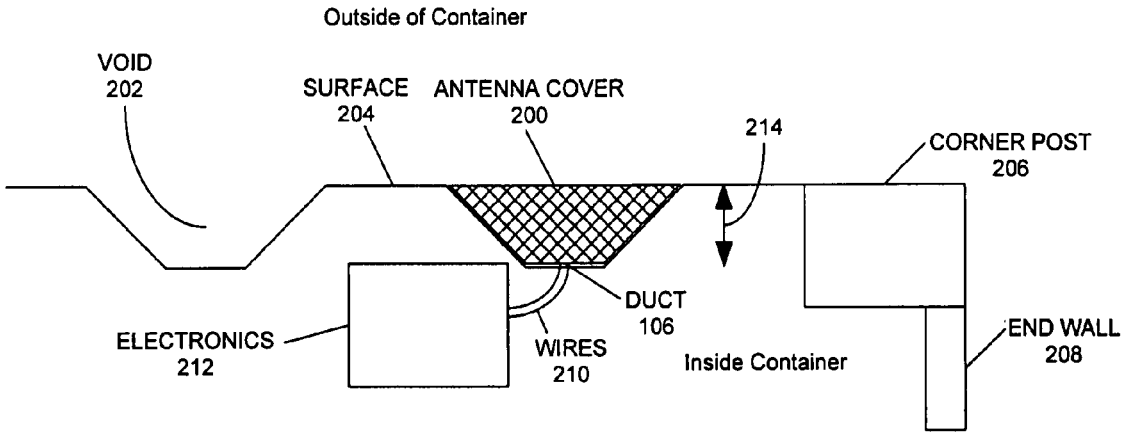
FIGS. 2A-2B illustrates views of the antenna cover used in the present invention.
Figure 2B:
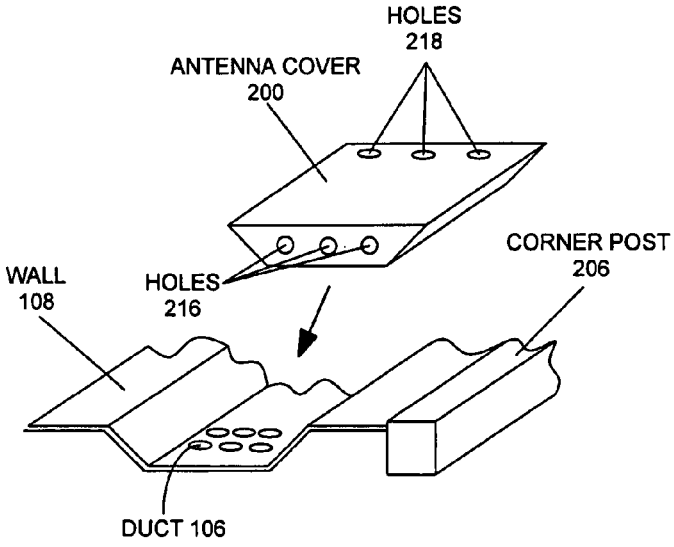

FIGS. 2A-2B illustrate views of the antenna cover used in the present invention.

FIG. 2A shows a top cutaway view of container 100. Wall 108 is typically corrugated, such that wall 108 will have additional strength for cargo purposes. As such, wall 108 has room for antenna cover 200 inside of the voids 202 and alongside surfaces 204 that are on the outside of container 100. Antenna cover 200 can be placed at least partially underneath rail 104 for protection. Essentially, antenna cover 200 is used to not only protect any antenna that may be inside of antenna cover 200, but to make any antenna somewhat unnoticeable from the outside of container 100. Corner post 206 and end wall 208 are also shown as part of container 100.

The ducts 106 provide a through hole for wires 210 for any electronics 212 that may be present inside of container 100. Such electronics may include Global Positioning System (GPS) receivers, transmitters to send status or other information regarding container 100 to a monitoring system, or other electronics. However, electronics 212, via ducts 106 and antenna cover 200, now can transmit and receive signals from outside of container 100. Further, antenna cover 200 can be used as the antenna or part of the antenna used for transmitting and/or receiving signals from outside of container 100.

Although shown as a chamfered fit into void 202, antenna cover 200 can take other shapes, such as a box, a dome, or other shapes without departing from the scope of the present invention. Essentially, the dimension 214 of antenna cover 200 are constrained by the corrugation of wall 108, and should not extend beyond the edge of container 100 defined by wall 108, to minimize damage to antenna cover 200 from movement of container 100 or movement of other containers 100 that can be placed alongside.

FIG. 2B shows a perspective view from the outside of container 100, where antenna cover 200 is placed over ducts 106 along wall 108. Antenna cover 200 is typically hollow, and therefore can contain an antenna which is used for transmission and reception of signals outside of container 100. Further, antenna cover 200 provides a reasonable amount of weather protection for any cargo inside of container 100, as well as protection for any antenna mounted inside of antenna cover 200.

Antenna cover 200 can be made from RF transmissive materials, or, if desired, can be made from a material that transmits RF signals, such that antenna cover 200 becomes part of the antenna used to transmit and receive signals for electronics 212.

Antenna cover 200 can be attached to container 100 via screws or captive bolts, or antenna cover 200 can be attached by tape or other binding materials such as glue. Further, container 100 may have bolts welded onto wall 108 which can be used to mount antenna cover 200.

Antenna cover 200 is typically hollow, and can further comprise holes 216 and/or holes 218 to continue to allow holes 106 to provide ventilation for container 100. Holes 216 and/or holes 218 can be of various sizes, and can be placed on any surface of antenna cover 200 without departing from the scope of the present invention. Holes 216 and holes 218, if present, are covered with a baffle from inside of antenna cover to continue to provide weather protection for container 100 and also for weather protection for any antenna mounted inside of antenna cover 200.

Fan Cover Mount

Figure 3:
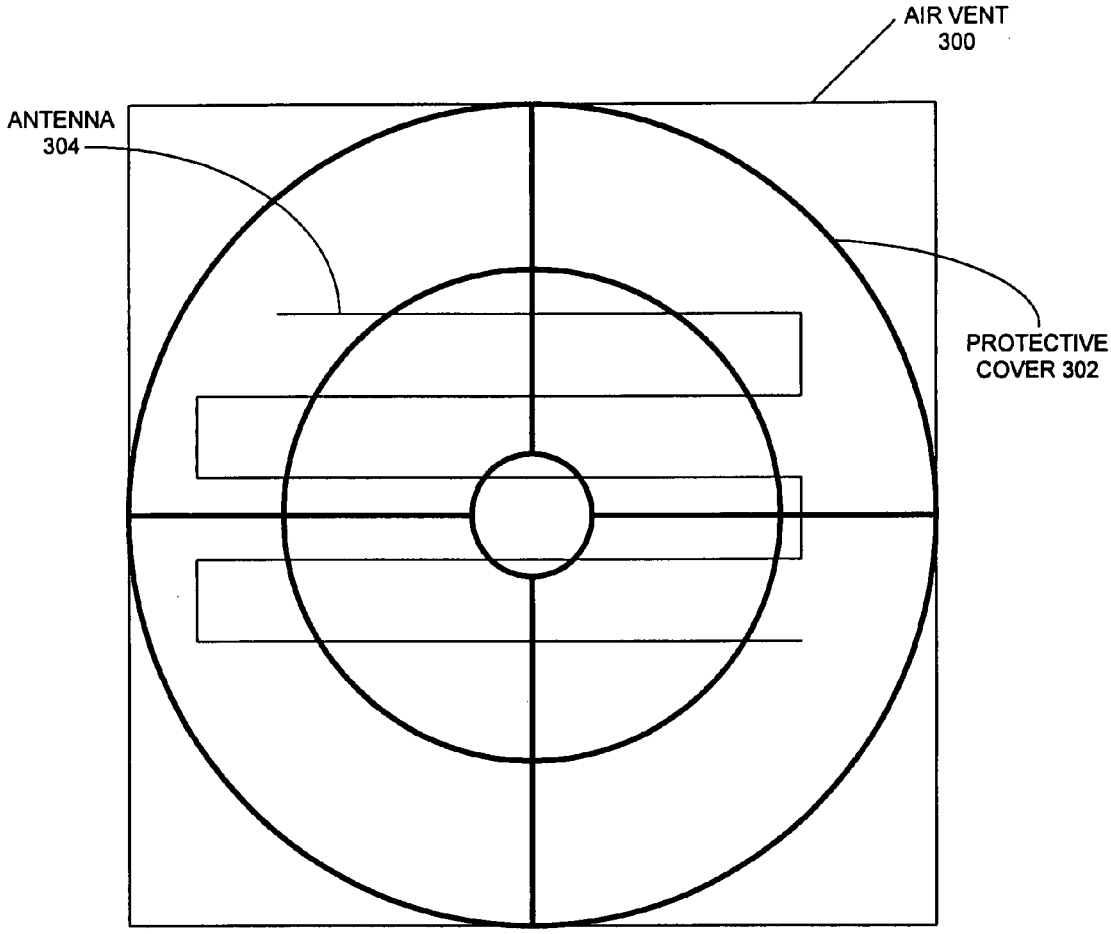
FIG. 3 illustrates another embodiment of an antenna cover in accordance with the present invention.

FIG. 3 illustrates an antenna in another embodiment of the present invention. Air vent 300 typically contains some sort of protective cover 302, which is typically a grid of wires or mesh, that can be electrically coupled to antenna 304 such that protective cover 302 can be used as the antenna 304, or, as shown in FIG. 3, an antenna 304 can be placed underneath the protective cover 302, much like antenna cover 200 protects any antenna mounted inside from potential tampering. Antenna 304 is typically attached to protective cover 302 through an attachment mechanism, such as cable ties or other items that would attach antenna 304 to protective cover 302 without unduly burdening the protective cover's mechanical properties or the RF properties required by antenna 304. Further, antenna 304 can be made to look like part of protective cover 302, or can be interwoven with protective cover 302 if desired. Although shown as a serpentine pattern, antenna 304 can take any shape as desired and needed by the container 100 to be able to transmit and receive the RF signals of interest. The antenna 304 can be placed between the fan blades and the protective cover 302, or elsewhere integrated with the protective cover 302 or air vent 300, without departing from the scope of the present invention.

Further, antenna 304 can transmit information to interested parties, such as container 100 geoposition, whether the container 100 has been entered or the door of container 100 has been opened (also known as an entry log), or other information such as temperature inside the container or other data of interest. Again, RF transmissive materials can be used to further protect and/or conceal antenna 304.

Figure 4:
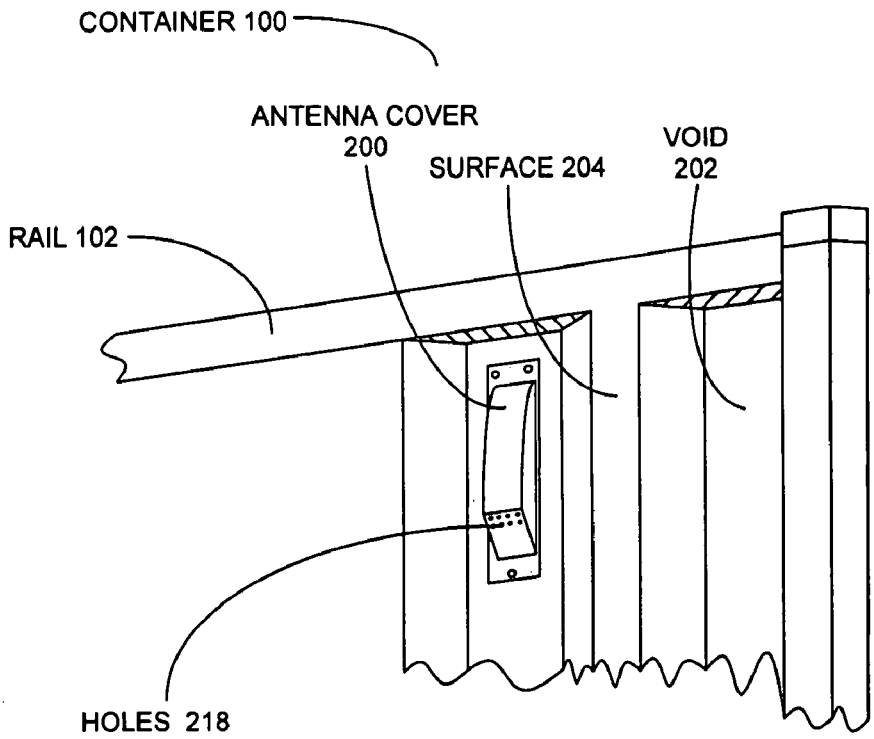
FIG. 4 illustrates an antenna cover installed on a cargo container in accordance with the present invention.

FIG. 4 illustrates an antenna cover installed on a cargo container in accordance with the present invention.

As shown in FIG. 4, antenna cover 200 fits within void 206, and does not have to extend to the edges of void 206. Antenna cover 200 has holes 218 to continue to allow for ventilation of container 100, but acts as protection for any antenna mounted inside of or integral to antenna cover 200.

Figure 5:
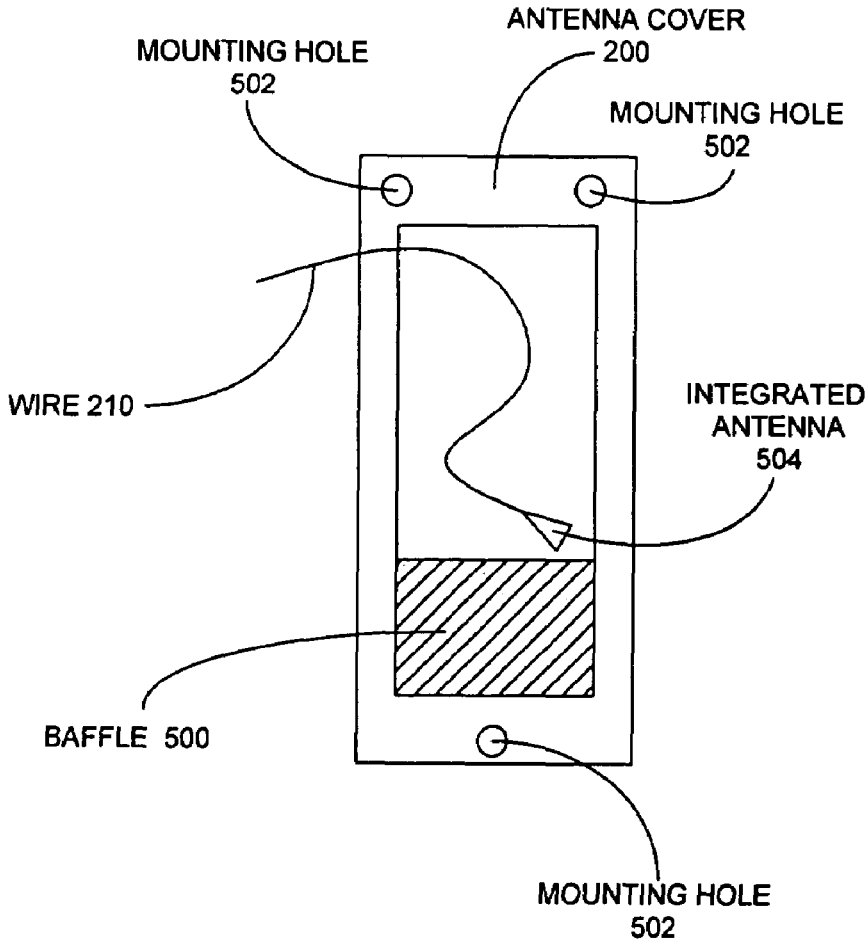
FIG. 5 illustrates an inside view of an antenna cover in accordance with the present invention.

FIG. 5 illustrates an inside view of an antenna cover in accordance with the present invention.

Antenna cover 200 may further comprise baffle 500, and has mounting holes 502 which can be located on the periphery of antenna cover 200. Further, wire 210, which is attached to antenna 504, is shown as fitting within the antenna cover 200. Alternatively, antenna 504 may be integrated with antenna cover 200, and wires 210 would then couple to the integrated antenna 504.

CONCLUSION

This concludes the description of the preferred embodiment of the invention. In summary, embodiments of the invention provide apparatuses for mounting an antenna on a cargo container. An embodiment of the present invention comprises an antenna cover, disposed for mounting within a void of a corrugated wall of the cargo container, the antenna cover mounting over at least one opening in the corrugated wall of the cargo container, wherein the antenna is disposed through the at least one opening and mounted inside of the antenna cover, such that the antenna is disposed to perform a function selected from a group comprising transmitting radio frequency (RF) radiation from outside the cargo container and receiving RF radiation from outside the cargo container.

Such an embodiment optionally further includes a dimension of the antenna cover not extending beyond a depth of the void of the corrugated wall of the cargo container, the antenna transmitting RF radiation to report information related to the cargo container, the information comprising location of the cargo container or an entry log of the cargo container, the antenna cover further comprising an RF transmissive material or being electrically coupled to the antenna such that the antenna cover is used as the antenna.

Another embodiment of the present invention comprises a protective cover mounted on the cargo container, the protective cover having at least one opening which is disposed to allow air to flow between an inside of the cargo container and an outside of the cargo container, and an attachment mechanism to attach the antenna to the protective cover, wherein the antenna is disposed to receive radio frequency (RF) radiation.

Such an embodiment optionally includes the antenna being mounted underneath the protective cover the protective cover being electrically coupled to the antenna such that the protective cover is used as the antenna, the antenna being interwoven with the protective cover, the antenna transmitting RF radiation to report information related to the cargo container, the information comprising location of the cargo container or an entry log of the cargo container, and an RF transmissive material coupled to the antenna.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto and the equivalents thereof.

What is claimed is:

1. An air vent cover for mounting an antenna on a cargo container, comprising:

an antenna cover, disposed for mounting within a void of a corrugated wall of the cargo container, the antenna cover mounting over at least one opening in the corrugated wall of the cargo container, the antenna cover having at least one opening which is disposed to allow air to flow between an inside of the cargo container and an outside of the cargo container;

wherein the antenna is disposed through the at least one opening and mounted inside of the antenna cover, such that the antenna is disposed to perform a function selected from a group comprising transmitting radio frequency (RF) radiation from outside the cargo container and receiving RF radiation from outside the cargo container.

2. The air vent cover of claim 1, wherein a dimension of the antenna cover does not extend beyond a depth of the void of the corrugated wall of the cargo container.

3. The air vent cover of claim 2, wherein the antenna transmits RF radiation to report information related to the cargo container.

4. The air vent cover of claim 3, wherein the information comprises location of the cargo container.

5. The air vent cover of claim 4, wherein the information comprises an entry log of the cargo container.

6. The air vent cover of claim 5, wherein the antenna cover further comprises an RF transmissive material.

7. The air vent cover of claim 5, wherein the antenna cover is electrically coupled to the antenna such that the antenna cover is used as the antenna.

8. An apparatus for mounting an antenna on a cargo container in an air vent cover of the cargo container, comprising:

a protective cover mounted on the cargo container, the protective cover having at least one opening which is disposed to allow air to flow between an inside of the cargo container and an outside of the cargo container;

an attachment mechanism to attach the antenna to the protective cover, wherein the antenna is disposed to receive radio frequency (RF) radiation.

9. The apparatus of claim 8, wherein the antenna is mounted underneath the protective cover.

10. The apparatus of claim 8, wherein the protective cover is electrically coupled to the antenna such that the protective cover is used as the antenna.

11. The apparatus of claim 8, wherein the antenna is interwoven with the protective cover.

12. The apparatus of claim 8, wherein the antenna transmits RF radiation to report information related to the cargo container.

13. The apparatus of claim 12, wherein the information comprises location of the cargo container.

14. The apparatus of claim 13, wherein the information comprises an entry log of the cargo container.

15. The apparatus of claim 14, further comprising an RF transmissive material coupled to the antenna.

16. A method for tracking a cargo container with radio frequency (RF) transmissions using the apparatus of claim 1.

17. A method for tracking a cargo container with radio frequency (RF) transmissions using the apparatus of claim 8.

* * * * *